United States Patent [19]

Warner

[11] Patent Number: 4,861,281

[45] Date of Patent: Aug. 29, 1989

[54] ELECTRICAL JACK UNIT

[75] Inventor: Robert J. Warner, Veradale, Wash.

[73] Assignee: Telect, Inc., Spokane, Wash.

[21] Appl. No.: 239,459

[22] Filed: Sep. 1, 1988

[51] Int. Cl.[4] ..... H01R 13/60

[52] U.S. Cl. ..... 439/540; 439/668

[58] Field of Search ..... 439/668, 669, 710, 714, 439/716, 717, 684, 715, 540

[56] References Cited

U.S. PATENT DOCUMENTS

| | | | |
|---|---|---|---|
| 3,784,962 | 1/1974 | Byrd | 439/668 |
| 3,822,415 | 7/1974 | Deitch | 339/17 R |
| 3,852,703 | 12/1974 | Carney et al. | 439/668 |
| 4,073,563 | 2/1978 | Bailey et al. | 339/128 |
| 4,368,941 | 6/1983 | Martin | 339/183 |
| 4,423,466 | 12/1983 | Beun | 439/668 |
| 4,588,251 | 5/1986 | Newton | 439/668 |
| 4,737,113 | 4/1988 | Hopper et al. | 439/668 |

FOREIGN PATENT DOCUMENTS

| | | | |
|---|---|---|---|
| 504188 | 6/1920 | France | 439/669 |

*Primary Examiner*—David Pirlot

*Attorney, Agent, or Firm*—Wells, St. John & Roberts

[57] ABSTRACT

A modular electrical jack unit 40 is described having a cast frame structure 42 for supporting and aligning a plurality of jack spring switch assemblies 70, 72 and 74. The cast frame structure 42 has a sleeve section 44 and a beam section 46. The sleeve section 44 has a plurality of sleeve members 52, 54 and 56. The beam member 46 has support beams 60 and 64 that extend rearward substantially perpendicular to the sleeve section 44 at spaced intervals with the support beam 60 extending rearward between sleeve member 52 and 54 and the support beam 64 extending rearward between sleeve member 54 and 56. The jack spring switch assemblies 70, 72 and 74 are mounted on the support beams 60 and 64 with the jack spring switch assembly 72 positioned intermediate the support beams 60 and 64. The jack spring switch assemblies 70, 72 and 74 are stacked vertically aligned with each other and are aligned with sleeve members 52, 54 and 56 respectively. The support beams 60 and 64 prevent the switch assemblies from twisting and more effectively secures the switch assemblies and reduces moment forces that would otherwise deteriorate the effectiveness of the unit with extended use.

9 Claims, 5 Drawing Sheets

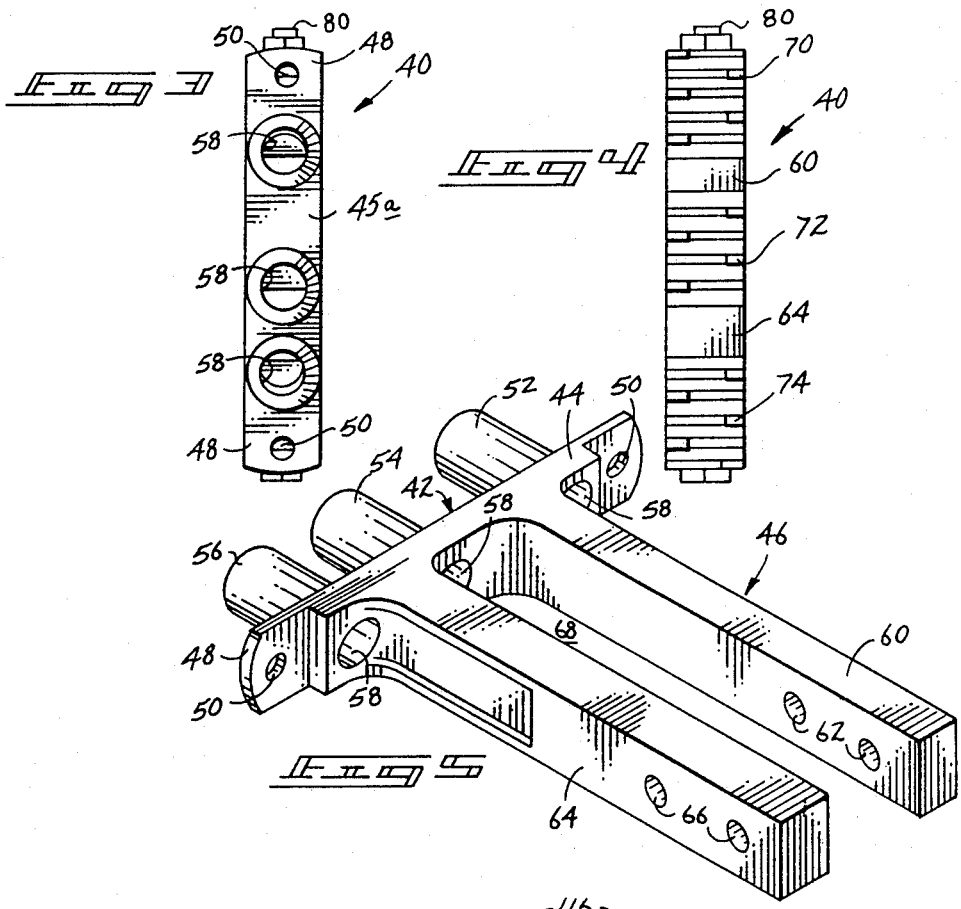
Fig 3
Fig 4
Fig 5
80
50
48
40
58
45a
70
60
72
64
74
52
44
42
54
56
46
68
62
66
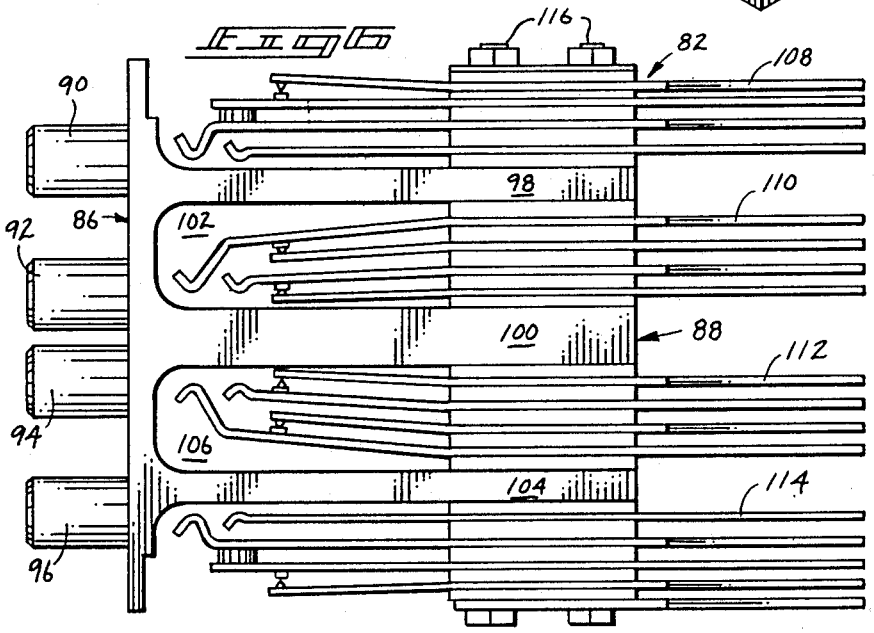
Fig 6
116
82
108
90
98
110
92
86
102
100
88
112
94
106
104
114
96

Fig 10
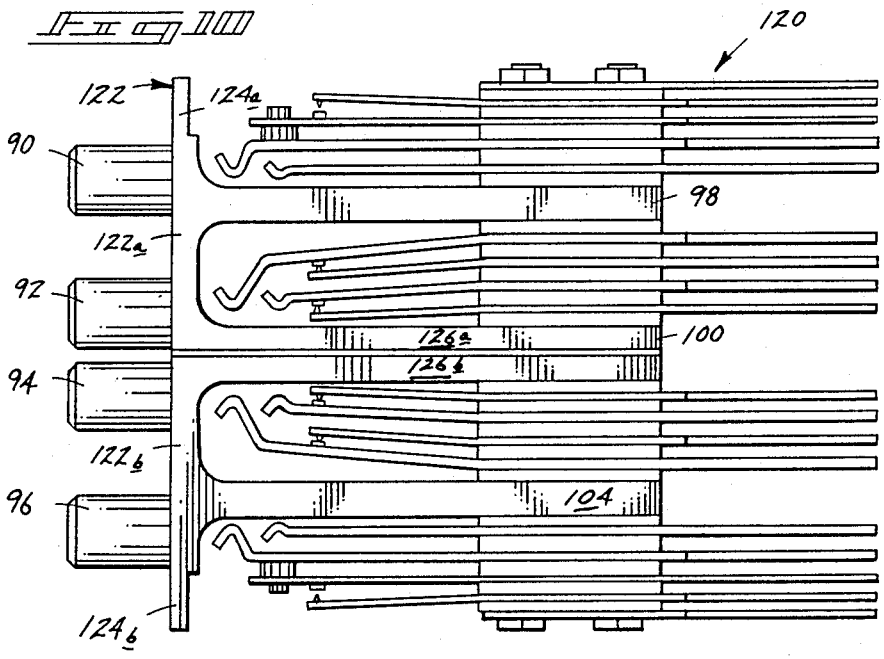
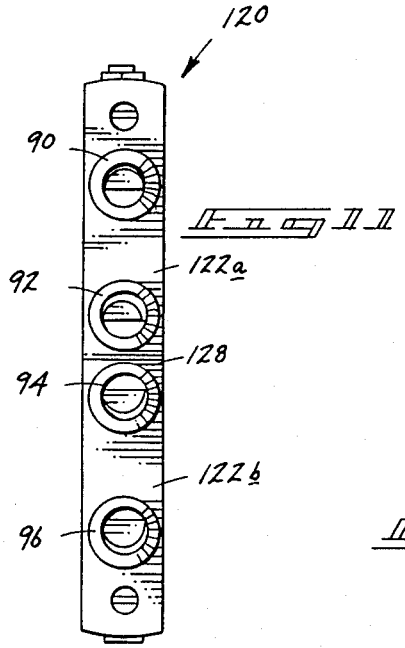
Fig 11
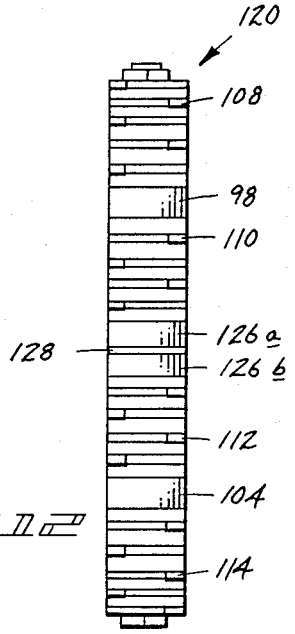
Fig 12

ELECTRICAL JACK UNIT

TECHNICAL FIELD

This invention relates to electrical jacks of the type adapted for side-by-side mounting in electrical cross-connect jack panels found in telephone and other telecommunication exchanges.

BACKGROUND OF THE INVENTION

In the prior art there are several forms of electrical jacks that have been adapted for side-by-side mounting in an electrical jack panel. An example is shown in U.S. Pat. No. 3,822,415. More recent electrical jack units are illustrated in U.S. Pat. Nos. 4,073,463 granted Feb. 14, 1978 to James R. Bailey et al. and 4,368,941 granted Jan. 18, 1983 to Ronald G. Martin. The Martin U.S. Pat. No. 4,368,941 illustrates a jack frame that is formed of a single cast material similar to that shown in FIG. 1 of this application. To assist in understanding the present invention it is helpful to understand some of the details of the prior art unit.

The prior art electrical jack unit is identified with the numeral 10 having an integral cast frame 12 with a sleeve section 14 and a support beam section 15. The support beam section 15 includes a single support beam 16 that extends outward at a right angle to the sleeve section 14.

The sleeve section 14 includes an output monitor sleeve member 18, an output sleeve member 20 and an input sleeve member 22 that extend outward from a forward surface of the sleeve section for receiving cylindrical jack plugs. The sleeve section 14 has mounting holes 24 at the ends thereof for mounting the electrical jack unit in parallel side-by-side relationship with other jack units in an electrical jack panel.

The prior art electrical jack unit 10 includes three jack spring switch assemblies that are identified as a monitor output jack spring switch assembly 26, an output jack spring switch assembly 28 and an input jack spring switch assembly 30. Each of the switch assemblies 26, 27 and 30 correspond with respective sleeve members 18, 20 and 22. The switch assemblies 26, 28 and 30 are secured to the support beam 16 by bolts 32 that extend through the switch assemblies and the support beam 16.

Although the electrical jack unit 10 illustrated in FIG. 1 was a substantial improvement in the technology, it still possessed significant weaknesses. Although the cast frame 12 is quite rigid it does permit the spring assemblies 26, 28 and 30 to twist with respect to the support beam 16 in a lateral direction enabling the switch contacts to engage adjacent switch contacts of adjacent units, causing electrical shorting. Furthermore the insertion of cylindrical jack plugs into their respective sleeve members 18, 20 and 22 caused substantial moment forces to be produced with respect to the bolts 32 minimizing the pressure that can be applied to the physical switch contacts. Furthermore over time the switch assemblies become loose and are rendered ineffective.

One of the principal objects of this invention is to provide a much improved electrical jack unit that overcomes many of the disadvantages of the prior art electrical jack units, particularly with respect to the electrical jack unit 10 illustrated in FIG. 1. The advantages of this invention will become apparent upon reading the following detailed description of a preferred embodiment.

BRIEF DESCRIPTION OF THE DRAWINGS

Preferred and alternate embodiments of the invention are illustrated in the accompanying drawings, in which:

FIG. 3 is a front view of the electrical jack unit illustrated in FIG. 2.

FIG. 4 is a rear view of the electrical jack unit illustrated in FIG. 2;

FIG. 5 is an isometric component view of a jack frame structure of the electrical jack unit illustrated in FIG. 2;

FIG. 6 is a side view of an alternate embodiment of an electrical jack unit;

FIG. 10 is a side view of a second alternate embodiment of an electrical jack unit;

FIG. 11 is a front view of the electrical jack unit illustrated in FIG. 10;

FIG. 12 is a rear view of the electrical jack unit illustrated in FIG. 10.

DETAILED DESCRIPTION OF PREFERRED AND ALTERNATE EMBODIMENTS

The following disclosure of embodiments of the invention is submitted in compliance with the constitutional purpose of the Patent Laws "to promote the progress of science and useful arts" (Article 1, Section 8).

Figure 1:
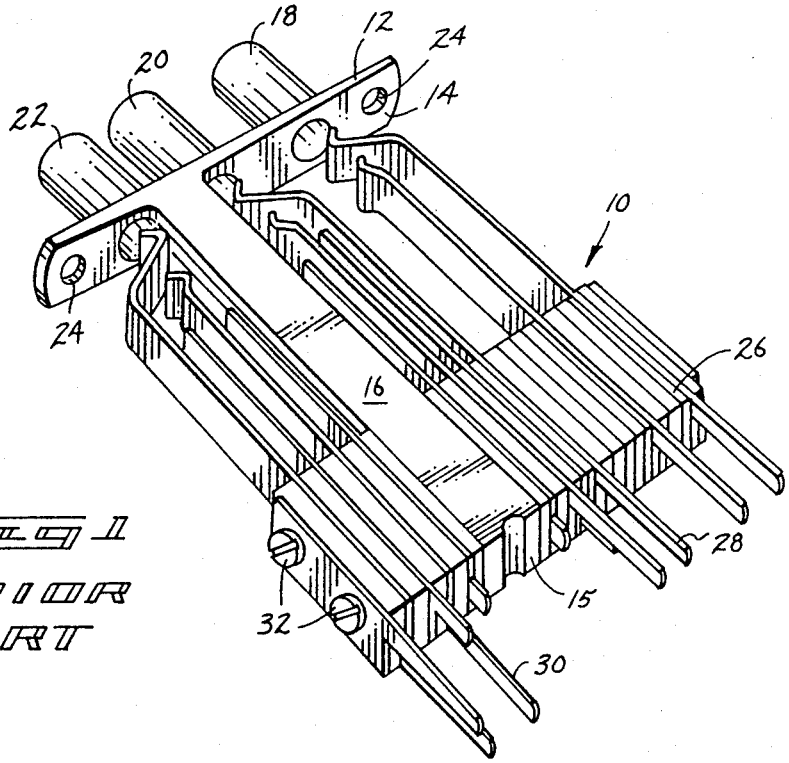
FIG 1 PRIOR ART
FIG. 1 is directed to an electrical jack unit 10 of the prior art particularly illustrated in the Martin U.S. Pat. No. 4,368,941.
Figure 2:
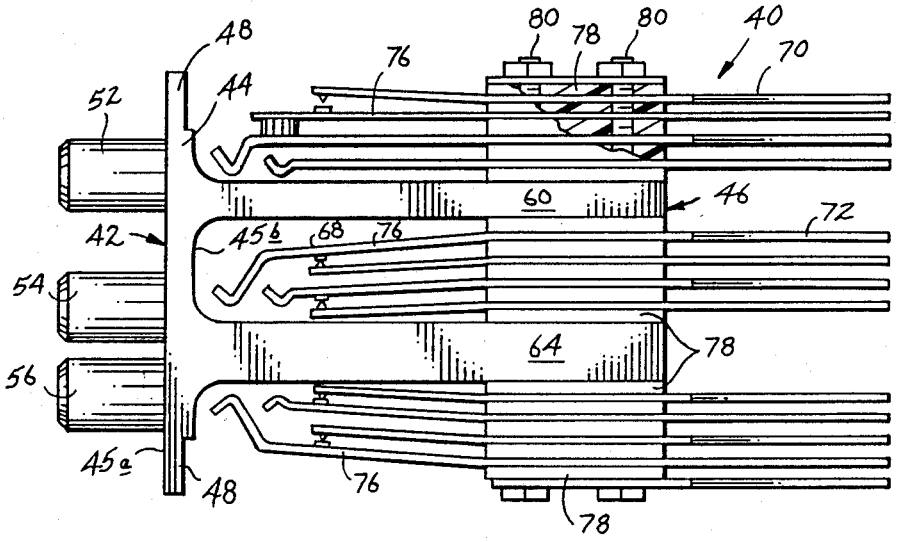
FIG. 2 is a side view of a preferred embodiment illustrating an electrical jack frame supporting a stack of jack spring switch assemblies.
Figure 7:
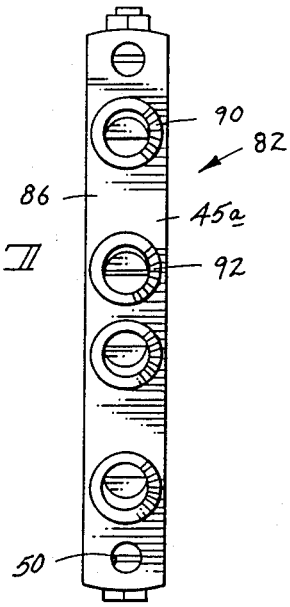
FIG. 7 is a front view of an electrical jack unit illustrated in FIG. 6.
Figure 8:
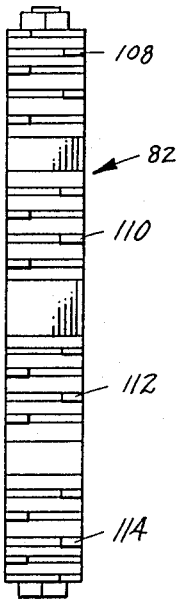
FIG. 8 is a rear view of the electrical jack unit illustrated in FIG. 6.
Figure 9:
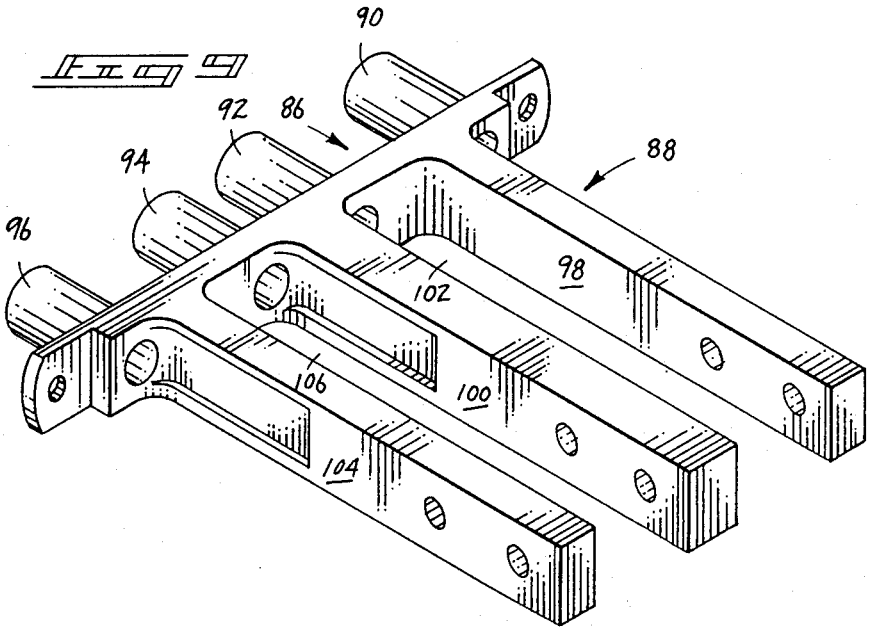
FIG. 9 is a isolated isometric view of a cast frame structure of the electrical jack unit illustrated in FIG. 6.
Figure 13:
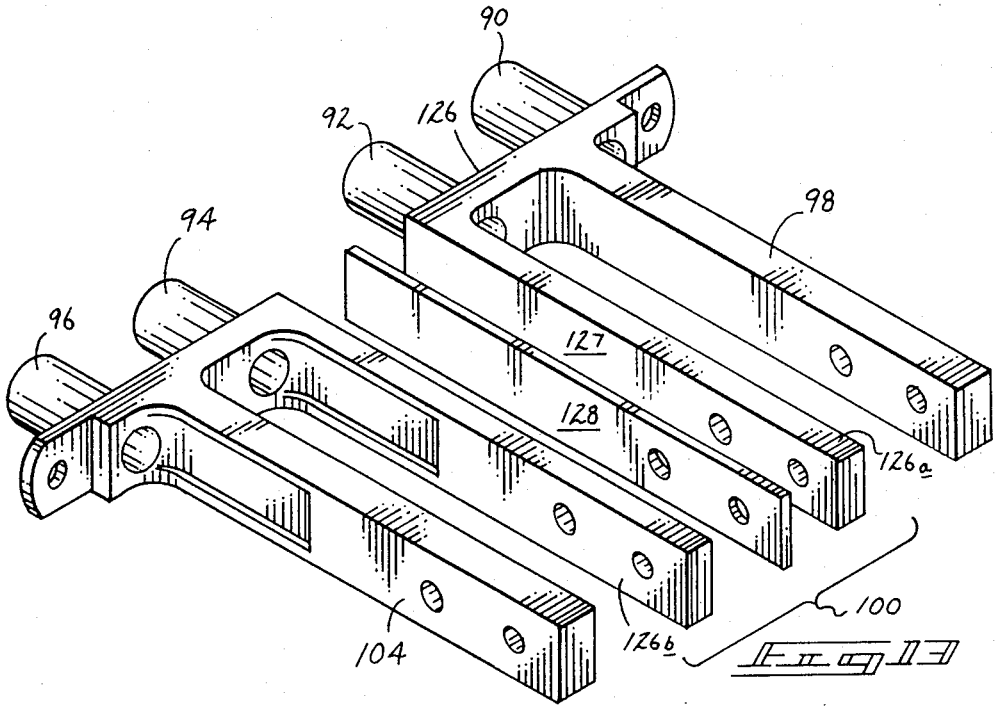
FIG. 13 is a isolated isometric view of a cast frame structure of the electrical jack unit illustrated in FIG. 10.

Referring now to the drawings, FIG. 2 illustrates an electrical jack unit generally designated with the numeral 40 that incorporates the preferred embodiment of this invention. The electrical jack unit 40 has a cast frame structure 42 made of a nonferrous, electrically conductive material. The cast frame structure 42 includes a sleeve section 44 that has a front face 45A and a rear face 45B. The cast frame structure 42 further includes a beam section 46 that is formed integrally with the sleeve section 44 and extends outward cantilevered from the rear face 45B substantially perpendicular to the sleeve section 44.

The sleeve section 44 has upper and lower outer mounting ends 48 with holes 50 formed therein for enabling the electrical jack unit 40 to be mounted to an electrical jack panel adjacent to other electrical jack units that provides access to telecommunication circuits that are connected to the electrical jack panel.

Sleeve section 44 includes an output monitor sleeve member 52 that is spaced from an output sleeve member 54 which is in turn spaced from an input sleeve member 56. Each of the sleeve members 52, 54 and 56 extend outward from the front face 45 perpendicular to the elongated direction of the sleeve section 44. Each of the sleeve members 52, 54 and 56 include a cylindrical bore 58 formed therein passing through the front surface 45A to the rear surface 45B. The cylindrical bore 58 is designed to receive a cylindrical jack plug, that is not illustrated, for making frictional electrical contact with spring contact switches.

The beam section 46 includes a support beam 60 that extends outward cantilevered from the rear surface 45B in a substantially perpendicular orientation to the sleeve section 44. The support beam 60 extends outward intermediate the output monitor sleeve member 52 and the output sleeve member 54. The support beam 60 includes mounting holes 62 (FIG. 5) that extend therethrough in a vertical direction substantially parallel with the sleeve section 44.

The beam section 46 further includes a support beam 64 that extends outward cantilevered from the sleeve section 44 parallel but spaced from the support beam 60 intermediate the output sleeve member 54 and the input sleeve member 56. The support beam has holes 66 formed vertically therethrough that are vertically aligned with the holes 62. The support beam 64 is spaced from the support beam 60 a sufficient distance forming an open-ended U-shaped cavity 68.

The electrical jack unit 40 includes three jack spring switch asemblies 70, 72 and 74. The monitor output jack spring switch assembly 70 is mounted on top of the support beam 60 in alignment with the output monitor sleeve member 52. The output jack spring switch assembly 72 is mounted in the cavity 68 to the bottom side of support beam 60 and to the top side of the support beam 64. The input jack spring switch assembly 74 is mounted to the underside of the support beam 64 in alignment with the input sleeve member 56. Each of the switch assemblies 70, 72 and 74 include electrically conductive spring blades 76 that are spaced by insulation spacers 78. The contacts of the spring blades 76 are movable perpendicularly to the support beams 60, 64.

The switch assemblies 70, 72 and 74 are securely mounted to the support beams 60 and 64 by bolts 80 that extend vertically through the switch assembly 70, 72 and 74 and through the mounting holes 62 and 66 in the support beams 60 and 64. The two support beams 60 and 64, in conjunction with the bolts 80 securely mount the switch assemblies 70, 72 and 74 in a very rigid manner to prevent any lateral twisting. Furthermore the support beams 60 and 64 minimize the creation of moment forces that may be created on the spring assemblies when a cylindrical jack plug is inserted into one of the sleeve members 52, 54 or 56. Consequently the electrical jack unit 40 has a considerably longer life and is considerably less likely to become loose or to become ineffective after considerable use.

Furthermore the support beams 60 and 64 provide greater rigidity enabling use of increased spring contact pressure between the blades 76 and the jack plug to provide more consistent electrical contact. Furthermore, the support beams 60 and 64 provide isolation RF shielding between the switch assemblies 70, 72 and 74 to minimize frequency interference. Particularly support beam 60 provides RF shielding for a monitor signal that is carried by the switch assembly 70. This feature is particularly important for high frequency communication transmission.

Furthermore the support beams 60 and 64 provide for a more vertical parallel stack of switches enabling the electrical jack units 40 to be mounted adjacent other electrical jack units in an electrical jack panel with less tendency for electrical shorting between adjacent electrical jack units. Such a feature also minimizes the number of units that need to be "reworked" because of twisting or misalignment of the switch assemblies.

An alternate embodiment of the electrical jack unit is illustrated in FIGS. 6–9. The electrical jack unit illustrated in FIG. 6 is identified generally with the numeral 82. The unit 82 has a cast frame structure with a sleeve section 86 and a beam section 88. Sleeve section 86 includes an output monitor sleeve member 90, an output sleeve member 92, an input sleeve member 94 and input monitor sleeve member 96. The beam section 88 includes three spaced support beams. The support beam 98 extends outward from the rear surface intermediate the output monitor sleeve 90 and the output sleeve 92. The second support beam 100 extends outward from sleeve section 86 intermediate the output sleeve member 92 and the input sleeve member 94 forming a cavity 102 between the support beams 98 and 100. The third support beam 104 extends outward perpendicular to the sleeve section 86 intermediate the input sleeve 94 and the input monitoring sleeve member 96 forming a cavity 106 intermediate the support beams 100 and 104.

The electrical jack unit 82 has four jack spring switch assemblies. Specifically the unit 82 includes an output monitor jack spring switch assembly 108 that is aligned with the output monitor sleeve 90 and is mounted to the top surface of support beam 98. An output jack spring switch assembly 110 is mounted in the cavity 102 between the support beams 98 and 100 in alignment with the output sleeve 92. An input jack spring switch assembly 112 is mounted in the cavity 106 between support beam 100 and support beam 104 in alignment with the input sleeve 94. An input monitor jack spring switch assembly 114 is mounted beneath the support beam 104 in alignment with the input monitor sleeve member 96. Bolts 116 extend through the switch assemblies 108, 110, 112, and 114 and the support beams 98, 100 and 104 for securing the switch assemblies rigidly to the three support beams.

An alternate embodiment is illustrated by the electrical jack unit 120 in FIGS. 10–13. Unit 120 is similar to unit 82 however it has a cast frame structure 122 that is formed of two identical cast components 122A and 122B. The structure 122 includes two sleeve sections 124A and 124B. The intermediate support beam 100 is bifurcated having support beam segments 126A and 126B. The bifurcated support elements 126A and 126B have facing surfaces 127 with an insulator layer 128 mounted therebetween. Insulator layer 128 provides additional insulative properties. It should be noted that in the electrical jack unit 82 and the electrical jack unit 120 that the support beams 98, 100 and 104 provide additional RF shielding between the switch assemblies, particularly the outside monitor switch assemblies 108 and 114. The cast frame structure 122 has the advantage of being formed of smaller and less complicated castings 122A and 122B.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. In a modular electrical jack unit having a stack of jack spring switch assemblies that is adapted for side-by-side mounting with other modular electrical jacks in an electrical jack panel, a jack frame comprising:

an integral cast frame body, said body having an elognated jack sleeve section extending between upper and lower mounting ends that are adapted to connect to the electrical jack panel, said elongated jack sleeve section having a front face and a rear face, said elongated jack sleeve section having a plurality of spaced jack sleeve members formed therein that extend outward from and normal to the front face of the elongated jack sleeve section, each of the spaced jack sleeve members having a cylindrical bore extending therethrough to the rear face of the elongated jack sleeve section to receive a cylindrical jack plug therein, said body having two or more vertically spaced support beams cantilevered outwardly from the rear surface of the elongated jack sleeve section and forming at least one open-ended U-shaped cavity between them, the support beams being adapted to vertically support a stack containing a plurality of jack spring switch assemblies spaced from and in vertical alignment with one another, in which contacts of the jack spring switch assemblies are movable perpendicular to the support beams, in which at least one of the jack spring switch assemblies is supported within the open-ended U-shaped cavity between a pair of adjacent support beams; and said support beams extending outward from the rear surface of the elongated jack sleeve section intermediate adjacent jack sleeve members to more evenly support the stack of jack spring switch assemblies and maintain the stack of stack spring switch assemblies in vertical alignment with each other.

2. The jack frame as defined in claim 1 wherein the jack frame is cast of an electrically conductive material.

3. The electrical jack unit as defined in claim 1 wherein the elongated jack sleeve section has a monitor jack sleeve, an output jack sleeve, and an input jack sleeve, and wherein the jack spring switch assemblies include an output monitor jack spring switch assembly, an output jack spring switch assembly, and an input jack spring switch assembly and wherein one of the beams extends outward between the output monitor jack sleeve and the output jack sleeve and the other beam extends outward between the output jack sleeve and the input jack sleeve for supporting (1) the monitor jack spring switch assembly above the one beam, (2) the output jack spring switch assembly within the cavity formed between the two beams, and (3) the input jack spring switch assembly below the other beam.

4.The jack frame as defined in claim 1 wherein the beams have bolt apertures formed therein that are vertically aligned with each other and adapted to receive bolts that extend through the jack spring switch assemblies to secure the jack spring switch assemblies in the vertical stack with at least one of the jack spring switch assemblies secured between the two beams.

5. The jack frame as defined in claim 1 wherein the body has three vertically spaced beams cantilevered from the rear face of the elongated jack sleeve section for vertically supporting a stack of jack spring switch assemblies.

6. The jack frame as defined in claim 5 wherein the elongated jack sleeve section includes an output sleeve member, an input sleeve member, an output monitor sleeve member, and an input monitor sleeve member and wherein one of the beams extends outward from the rear face of the elongated jack sleeve section intermediate the output monitor sleeve member and the output sleeve member and wherein the second beam extends outward from the rear face of the elongated jack sleeve section intermediate the output sleeve member and the input sleeve member and wherein the third beam extends outward from the rear face of the elongated jack sleeve section intermediate the input sleeve member and the input monitor sleeve member.

7. In a modular electrical jack unit having a stack of jack spring switch assemblies that is adapted for side-by-side mounting with other modular jack units in an electrical jack panel, a jack frame comprising:

two matching cast bodies that are adapted to be secured together to form a rigid frame structure;

each of said cast bodies having an elongated jack sleeve section with a mounting end adapted to connect to the electrical jack panel and a front surface and a rear surface;

each of said cast bodies having at least two spaced jack sleeve members formed therein and extending outward from and normal to the front face of its elongated jack sleeve section;

each of the spaced jack sleeve members having a cylindrical bore extending therethrough to the rear face of its elongated jack sleeve section to receive a cylindrical jack plug therein;

each of said bodies having a support beam cantilevered outwardly from the rear surface of its elongated jack sleeve section intermediate the two spaced jack sleeve members and a support beam segment extending outward from the rear face the support beam and support beam segment on each body forming an open-ended U-shaped cavity between them, with the support beam segments serving as an intermediate additional bifurcated support beam when the rigid frame structrue is assembled; in which contacts of the jack spring switch assemblies are movable perpendicular to the support beam segments; and an insulating layer mounted between the support beam segments of the two bodies to electrically separate the two bodies in the rigid frame structure.

8. The jack frame as defined in claim 7 wherein the elongated jack sleeve section of one cast body includes an output monitor sleeve member and an output sleeve member and the elongated jack sleeve section of the other cast body includes an input monitor sleeve member and an input sleeve member and wherein the support beam of the one cast body extends outward intermediate the output monitor sleeve member and the output sleeve member and wherein the support beam of the other cast member extends outward intermediate the input monitor sleeve member and the input sleeve member.

9. A modular electrical jack unit that is adapted for side-by-side mounting with other modular electrical jack units in an electrical jack panel, comprising:

a cast frame structure, said frame structure having an elongated jack sleeve section extending between mounting ends that are adapted to connect the modular electrical jack unit to the electrical jack panel adjacent the other modular electrical jack units;

said elongated jack sleeve section having a monitor output sleeve member, an output sleeve member, and an input sleeve member in which each of said sleeve members extend outward from a face surface of the elongated jack sleeve section;

each of the jack sleeve members having a cylindrical bore extending therethrough from the face surface of the elongated jack sleeve section to its rear surface, each jack sleeve member and cylindrical bore being adapted to receive a cylindrical jack plug therein;

said frame structure having two or more support beams cantilevered outwardly from the rear surface of the elongated jack sleeve sections, and forming at least one open-ended U-shaped cavity between them;

a plurality of jack spring switch assemblies mounted on the support beams in alignment with respective jack sleeve members in which at least one of the jack spring switch assemblies is mounted intermediate two of the support beams; in which contacts of the jack spring switch assemblies are movable perpendicular to the support beam; and common connector means securely mounting the jack spring switch assemblies across the open ends of the support beams for maintaining the jack spring switch assemblies in alignment with one another and the support beams.

* * * * *